US008570226B2

(12) United States Patent
Kao et al.

(10) Patent No.: US 8,570,226 B2
(45) Date of Patent: Oct. 29, 2013

(54) PORTABLE ELECTRONIC DEVICE WITH NEAR FIELD COMMUNICATION FUNCTION

(75) Inventors: Kung-Ming Kao, New Taipei (TW); Chun-Yu Lu, New Taipei (TW)

(73) Assignee: Chi Mei Communication Systems, Inc., New Taipei (TW)

( * ) Notice: Subject to any disclaimer, the term of this patent is extended or adjusted under 35 U.S.C. 154(b) by 279 days.

(21) Appl. No.: 13/216,249

(22) Filed: Aug. 24, 2011

(65) Prior Publication Data

US 2012/0287003 A1 Nov. 15, 2012

(30) Foreign Application Priority Data

May 10, 2011 (TW) ..... 100116256 A

(51) Int. Cl.
*H01Q 1/24* (2006.01)

(52) U.S. Cl.
USPC ..... 343/702; 343/867

(58) Field of Classification Search
USPC ..... 343/702, 867
See application file for complete search history.

(56) References Cited

U.S. PATENT DOCUMENTS

| | | | | |
|---|---|---|---|---|
| 6,304,231 | B1 * | 10/2001 | Reed et al. | 343/873 |
| 2005/0233781 | A1 * | 10/2005 | Erixon et al. | 455/575.1 |
| 2011/0312269 | A1 * | 12/2011 | Judd et al. | 455/11.1 |
| 2012/0034954 | A1 * | 2/2012 | Tabe | 455/566 |
| 2012/0229346 | A1 * | 9/2012 | Chen et al. | 343/702 |

* cited by examiner

*Primary Examiner* — Tan Ho
(74) *Attorney, Agent, or Firm* — Altis & Wispro Law Group, Inc.

(57) ABSTRACT

A portable electronic device includes a first housing, a second housing to the first housing, a circuit board, a display module, a touch panel, a near field communication (NFC) module, and a NFC antenna. The circuit board, the display module, the touch panel, the NFC module and the NFC antenna are orderly mounted in a space between the first housing and the second housing. The NFC antenna is set around the touch panel or at one side of the touch panel or the NFC module.

6 Claims, 4 Drawing Sheets

PORTABLE ELECTRONIC DEVICE WITH NEAR FIELD COMMUNICATION FUNCTION

BACKGROUND

1. Technical Field

The disclosure generally relates to portable electronic devices, and particularly to a portable electronic device with a near field communication (NFC) function.

2. Description of Related Art

NFC technology has become an increasingly popular form of connectivity technology. A portable electronic devices integrated with NFC function usually includes an NFC module connected to an NFC antenna. The NFC antenna includes a plurality of coiled wire loops connected to the NFC module. The NFC antenna is commonly mounted at an inner side of a rear housing of the portable electronic device. However, metal elements such as logos on rear housing may interfere with signals transmitted by the NFC antenna. In addition, when the portable electronic device is held by the user or put on a desk, signals transmitted by NFC antenna can be blocked by the hand of the user or the desk. Thus, the portable electronic device may have a weak and unstable NFC communication quality.

Therefore, there is room for improvement within the art.

BRIEF DESCRIPTION OF THE DRAWINGS

Many aspects of the present disclosure can be better understood with reference to the following drawings. The components in the drawings are not necessarily drawn to scale, the emphasis instead being placed upon clearly illustrating the principles of the disclosure.

DETAILED DESCRIPTION

Figure 1:
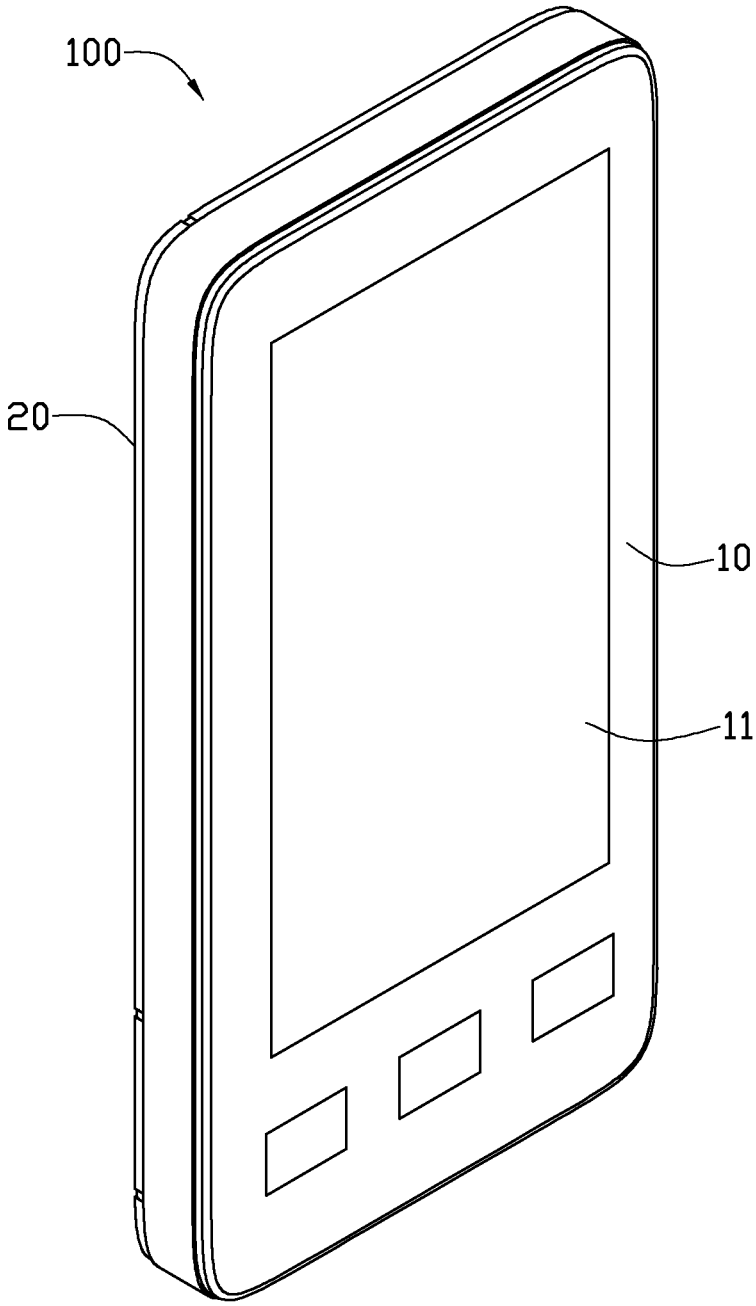
FIG. 1 is a schematic view of a portable electronic device, according to an exemplary embodiment.
Figure 2:
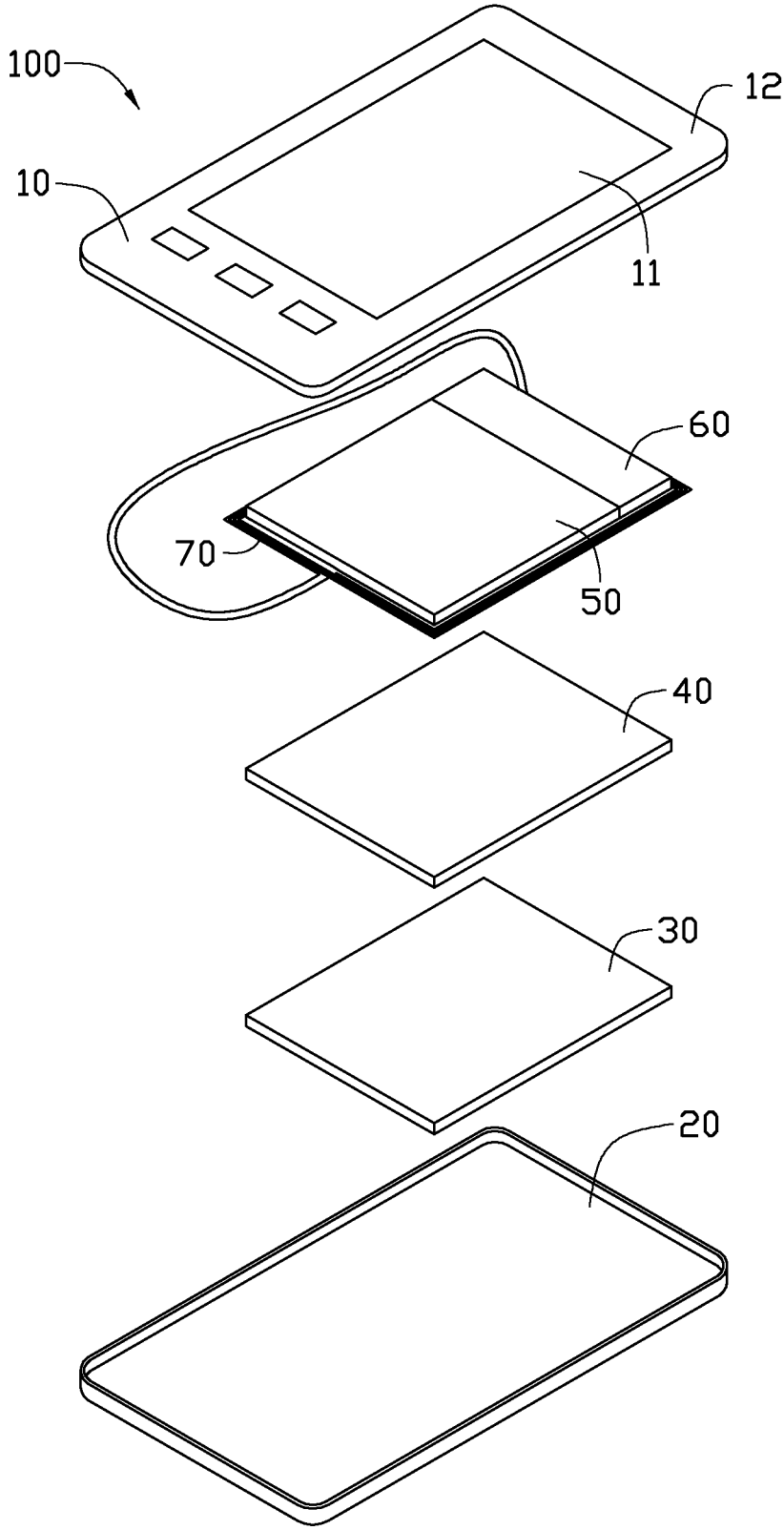
FIG. 2 is an exploded view of the electronic device shown in FIG. 1.

Referring to FIGS. 1 and 2, an embodiment of a portable electronic device 100 includes a first housing 10, a second housing 20, a circuit board 30, a display module 40, a touch panel 50, a NFC module 60 and a NFC antenna 70. The portable electronic device 100 can identify NFC tags for articles. The NFC tags store information of the articles, the article information including serial numbers for each article.

The first and second housings 10, 20 are shells for the portable electronic device 100. The second housing 10 is matched to the first housing 10, and can be assembled to the first housing 10 by latching structures or screws, defining a receiving space for a circuit board 30, a display module 40, a touch panel 50, a NFC module 60 and NFC antenna 70. The first housing 10 includes a screen 11 and a peripheral frame 12.

The circuit board 30 is a motherboard of the portable electronic device 100 to realize conventional functions thereof. The display module 40 is arranged on the circuit board 30 and electrically connected to the circuit board 30. The touch panel 50 is arranged on the display module 40. Information can be input to the portable electronic device 100 by touching the screen 11 and the touch panel 50.

The NFC module 60 is a flat microchip. When the article approaches the screen 11, the NFC module 60 identifies the NFC article tag and reads the corresponding article information from the NFC article tag. Thus, the article information can be displayed on the screen 11. In this embodiment, to obtain an integrated outer surface, the touch panel 50 is aligned and coplanar with the NFC module 60.

Figure 3:
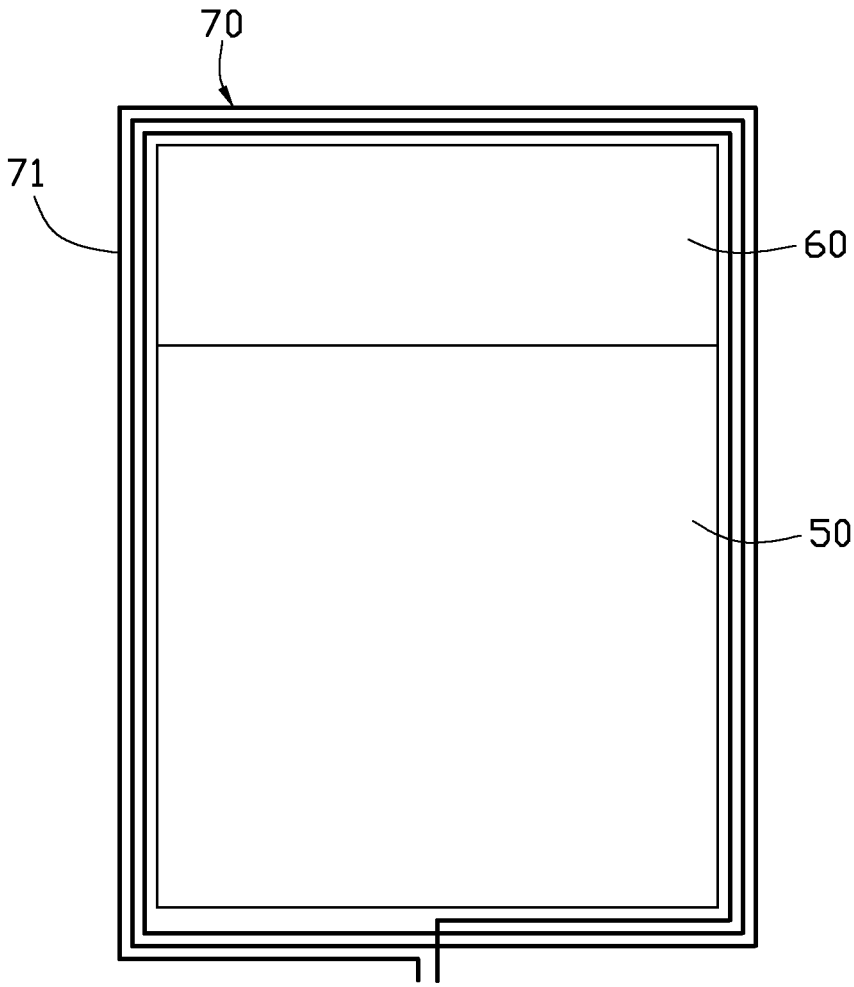
FIG. 3 is a planar schematic view of a touch panel, a NFC module and a NFC antenna of the electronic device shown in FIG. 1, according to an exemplary embodiment.

Referring to FIG. 3, the NFC antenna 70 includes a plurality coiled wire loops 71. In an exemplary embodiment, each loop 71 is substantially rectangular, and the number of the loops 71 is nine. The width of the loop 71 is about 0.5 mm. The width of a space between two adjacent loops 71 is also about 0.5 mm. The loops 71 are orderly arranged around the touch panel 50 and can be secured to the frame 12. Meanwhile, the two ends of the wire, which forms the loops 71 are electrically connected to the NFC module 60. Thus, the NFC module 60 can record NFC by the NFC antenna 70.

Figure 4:
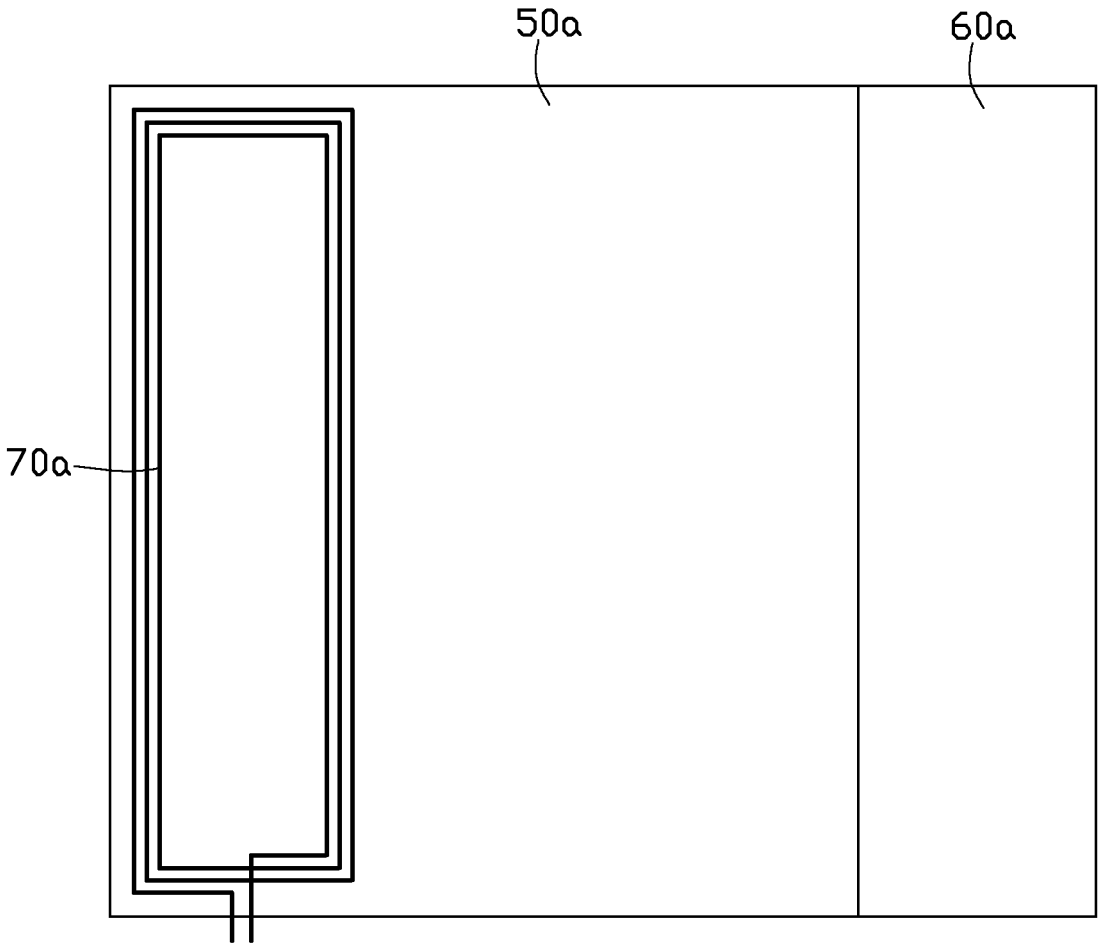
FIG. 4 is a planar schematic view of a touch panel, a NFC module and a NFC antenna of an electronic device, according to another exemplary embodiment.

Referring to FIG. 4, in another embodiment, when the dimensions of the screen 11 are large and a width of the frame 12 is narrow, for example, the portable electronic device 100 is a flat personal computer; it is difficult to attach the NFC antenna 70*a* to the frame 12. In addition, if the NFC antenna 70*a* is still set around the touch panel 50*a*, the number of the loops of the NFC antenna 70*a* is decreased, which may effect the signal radiation quality of the NFC antenna 70*a*. In this case, the NFC antenna 70*a* can be attached to one side of the touch panel 50*a* facing the display module 40. When the touch panel 50*a* is assembled to the display module 40, the NFC antenna 70*a* is sandwiched between the touch panel 50*a* and the display module 40.

In addition, the NFC antenna 70*a* also can be attached to one side of the NFC module 60*a*. When the NFC module 60*a* is assembled to the display module 70, the NFC antenna 70*a* is sandwiched between the NFC module 60*a* and the display module 40.

When the NFC antenna 70 is set around the touch panel 50, or set at one side of the touch panel 50*a* or the NFC module 60*a*, the NFC antenna 70 can transmit signals through the screen 11, and also can be apart from the second housing 20 by using the thickness of the portable electronic device 100. Therefore, the first housing 10 and the second housing 20 cannot block or interfere with signals transmitted from the NFC antenna 70.

Moreover, the NFC modules 60, 60*a* are opposite to the screen 11, when the article tag is identified by the NFC modules 60, 60*a*, the screen 11 can directly display the article information, which is convenient for viewing.

It is believed that the exemplary embodiments and their advantages will be understood from the foregoing description, and it will be apparent that various changes may be made thereto without departing from the spirit and scope of the disclosure or sacrificing all of its material advantages, the examples hereinbefore described merely being preferred or exemplary embodiments of the disclosure.

What is claimed is:

1. A portable electronic device, comprising:

a first housing;

a second housing assembled to the first housing;

a circuit board;

a display module;

a touch panel;

a near field communication (NFC) module; and a NFC antenna; wherein the circuit board, the display module, the touch panel, the NFC module and the NFC antenna are orderly mounted in a space between the first housing and the second housing, the NFC antenna is set around the touch panel or at one side of the touch panel or the NFC module.

2. The portable electronic device of claim 1, wherein the first housing includes a screen and a frame around the screen, when the NFC antenna is set around the touch panel, the NFC antenna is attached to the frame.

3. The portable electronic device of claim 1, wherein when the NFC antenna is attached to one side of the touch panel, the NFC antenna is sandwiched between the touch panel and the display module.

4. The portable electronic device of claim 1, wherein when the NFC antenna is attached to one side of the NFC module, the NFC antenna is sandwiched between the NFC module and the display module.

5. The portable electronic device of claim 1, wherein the NFC antenna includes a plurality coiled wire loops.

6. The portable electronic device of claim 1, wherein the touch panel and the NFC module is coplanar.

* * * * *